US005887407A

United States Patent [19]

Watkins

[11] Patent Number: 5,887,407

[45] Date of Patent: Mar. 30, 1999

[54] CLOTHING PROTECTION APPARATUS

[76] Inventor: Herbert E. Watkins, 2108 Sycamore La. East, Plant City, Fla. 33566

[21] Appl. No.: 753,395

[22] Filed: Nov. 26, 1996

[51] Int. Cl.[6] ..... B65B 67/04

[52] U.S. Cl. ..... 53/241; 53/256; 53/390; 206/289

[58] Field of Search ..... 53/241, 256, 255, 53/390, 567; 493/935; 223/85, 90, 89, 94, 92, 98, 120; 206/289, 298, 286, 279, 278

[56] References Cited

U.S. PATENT DOCUMENTS

| | | | |
|---|---|---|---|
| 1,064,375 | 6/1913 | Pomponio | 53/241 X |
| 1,652,579 | 12/1927 | Onken | 53/241 |
| 2,250,251 | 7/1941 | Blersch | 53/241 |
| 2,584,035 | 1/1952 | Lendle | 53/241 |
| 2,609,983 | 9/1952 | Denton | 53/256 X |
| 2,830,418 | 4/1958 | Drisko | 53/241 |
| 3,287,881 | 11/1966 | Jelling et al. | 53/256 |
| 4,147,010 | 4/1979 | Firsty | 53/241 X |

*Primary Examiner*—James F. Coan

[57] ABSTRACT

A clothing protection apparatus for protecting clothing or the like during storage and transportation. The apparatus having a top attachment device to secure onto the top of a door thus allowing the user to easily manipulate the invention during use. A lower attachment device is provided to support a clothing hanger and the accompanying garment for positioning before a protective cover is to be installed. A disposable box is used as the primary housing for the protective covers. A common roll of protective covering is provided with perforations between each cover.

5 Claims, 4 Drawing Sheets

CLOTHING PROTECTION APPARATUS

This invention relates to the protection of clothing articles during storage and transportation. More specifically, this invention is an apparatus that provides a plurality of protective covers from a roll to cover and protect a plurality of clothing articles. This invention also allows a single user to independently wrap and protect a plurality of clothing articles quickly and easily.

It has been customary to store clothes in common types of plastic covers to prevent dust and other contaminants from getting on expensive or valuable clothing articles. Typically the task of storing clothes inside of plastic covers requires two people to accomplish, one person to hold the cover open, and the other person to insert the clothing article. One such problem arises when the user tries to accomplish the task independently primarily because the plastic covers that are used are very thin and difficult to handle.

Several approaches have been provided for the storage of clothing articles, in Furst of U.S. Pat. No. 3,834,497, "A storage bag which can be used for camping or the like is substantially flat when not being used to accommodate articles so that it can be folded or rolled into a package of low bulk when stored. The bag is used in connection with a conventional clothes hanger and has an inner chamber for storing bulky items. Quick access to this chamber is provided by a slit or opening through a flat surface of the bag. Further , many additional articles may be stored in the bag by providing pockets on the front and rear surfaces thereof, which pockets are substantially flush with the flat bag when no articles are being stored therein." While this invention has its advantages, it does not provide a plurality of bags to accommodate a plurality of clothing articles to be covered for storage. Additionally, this type of storage device requires the user to hold the storage device with one hand while the other hand tries to insert the clothing article into a thin slit which is difficult. Furthermore, this type of storage device with all of its features makes the device expensive to protect a large number of clothing articles.

Another approach is taught by Kuroishi in U.S. Pat. No. 4,919,262, wherein "A portable clothes cover in which the clothes hanging down from the hanger or the like can be directly suspended on the suspender member of the upper bar, then enclosed by the cover section, and the cover section thus enclosing the clothes together with the hanger or the like can be securely maintained in the folded condition by folding this assembly in two and thereby locking the upper and lower bars to each other, followed by putting the sheath-like bag onto the cover section thus folded." A disadvantage of this portable clothes cover is that it will be too expensive to provide individual covers for each clothing article to be protected. Additionally, it may be too difficult for the average user to apply this method.

Still another approach is taught in the art of Creamer in U.S. Pat. No. 3,961,710 wherein "A clothes hanger support and storage assembly for conventional type wire clothes hanger is described and having an elongate base support member to which are connected a hanger support rod and a hanger retaining member such that clothes hangers positioned with their head portions on the hanger support rod contact the hanger retaining member and are prevented from tangling." While this invention has its advantages, it deals only with the storage of clothes hangers and does not directly apply to the storage and protection of clothing articles garments.

While some of the prior art may contain some similarities relating to the present invention, none of them teach, suggest or include all of the advantages and unique features of a clothing protection apparatus for protecting a plurality of clothing articles as the invention disclosed herein.

SUMMARY

Accordingly, it is an object of this invention to provide the user with a device that allows a single person to easily wrap clothing articles with commonly used protective covers for protection during storage and transportation.

Another object of this invention is to provide a clothing hanger affixing means located adjacent and below a roll of protective covers to allow the clothes hangers to hang with the clothing articles attached thereto.

Still another object of this invention is provide a clothing rail affixing means to secure onto a clothing rail to store the invention when the invention is not in use.

Still yet another object of this invention is to provide a vertical space between the clothing affixing means and a support member to allow a protective cover to wrap around most or the entire garment before the perforation part of the protective cover is cut.

A further object of this invention is to provide a door affixing means to secure to the top of a door while the invention is in use. This puts the invention in a convenient location ready for use.

Still a further object of this invention is to provide a pair of disassembly joints that allows the invention to be separated at these joints thereby allowing the invention to be stored compactly for easy storage or travel.

Another object of this invention is to save time by allowing a single independent user to easily and quickly protect and store clothing articles, rather than to need the help of an additional person during this process.

A further object of this invention is to provide a box for housing the roll of protective sheets that will allow the protective sheets to be dispensed there from.

Other objects and a fuller understanding of the invention will become apparent from reading the following detailed description of a preferred embodiment in conjunction with the accompanying drawings.

In carrying out this invention in the illustrative embodiment thereof, a clothing protection apparatus is provided for the protection of clothing articles during long term storage and transportation.

Conveniently, the user may assemble the clothing protection apparatus by inserting the rod through the slot provided in the box dispenser. The flexible chord is then attached to the rod and then the door attachment is hung over the top center of a door allowing the clothing protection apparatus to hang freely. Then, a clothes hanger with the clothing article to be covered is hung on the invention at the clothing affixing means site where the user then pulls down the first protective bag around the garment until the first perforation is located. The protective cover is then torn at the perforated mark and the hook of the clothing hanger is pulled through the opening provided at the top of the protective cover. The clothing hanger is then removed from the clothing affixing means site along with the clothing garment and protective cover and is ready for storage. The next clothing hanger along with the next clothing article to be covered is then installed onto the clothing affixing means site and the above steps are repeated until all the desired clothes are protected. When the task is completed, the user may conveniently store the clothing protection apparatus onto a clothing rail using the door affixed hanger.

BRIEF DESCRIPTION OF THE DRAWINGS

This invention, together with other objects, features, aspects and advantages thereof, will be more clearly understood from the following description, considered in conjunction with the accompanying drawings.

Four sheets of drawings are furnished, sheet one contains FIG. 1, sheet 2 contains FIG. 2, sheet 3 contains FIG. 3 and FIG. 4, and sheet 4 contains FIG. 5, and FIG. 6.

FIG. 1 shows a protective cover being unrolled down and over a clothing garment to be covered.

DESCRIPTION OF THE PREFERRED EMBODIMENTS

Figure 1:
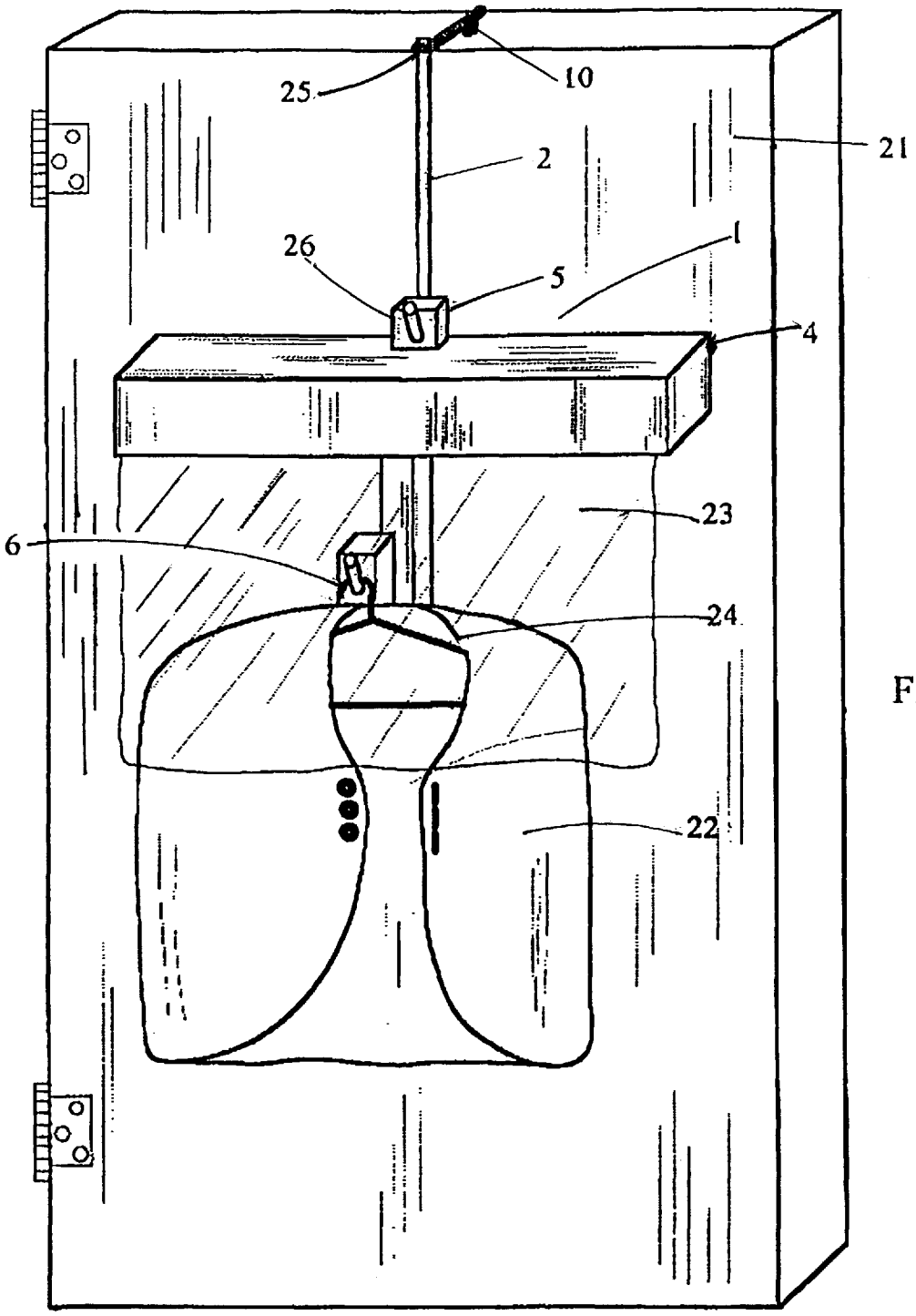
FIG. 1 is an orthographic view of the clothing protection apparatus completely assembled and installed onto the top qf a door.

Referring now to FIG. 1 a clothing protection apparatus referred to generally by the reference numeral 1 is made primarily of a support member 2, a disposable box 4, a door top affixing means 10. The door top affixing mean s 10 is shown hanging over the top of a door 21.

FIG. 1 shows the a box dispenser 4 affixed to the support member 2. The box dispenser 4 can vary in size to accommodate varying size diameters of roll protective covers. A single sheet 23 of the protective cover roll 16 is shown exposed out of the box 4 and being supported by box 4. The protective cover 23 is shown partially installed over a clothing hanger 24 and a clothing article 22.

Figure 2:
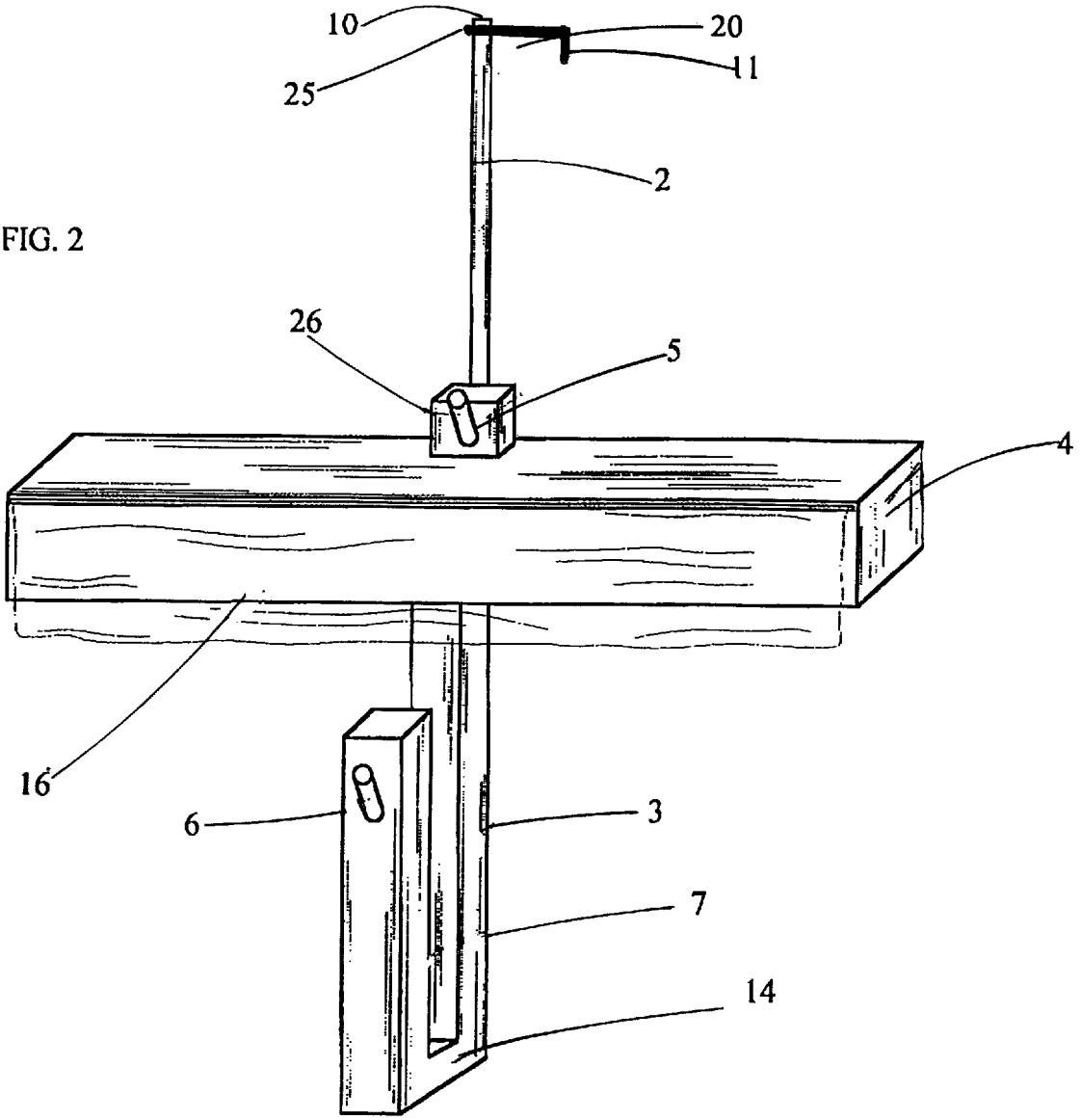
FIG. 2 is an orthographic view of the clothing protection apparatus clearly showing a box for housing the protective covers, a door attachment holder, a clothing affixing means, a roll of protective covers.

Referring now to FIG. 2 we see the clothing protection apparatus 1 completely assembled having a support member 2 which is affixed to a door top affixing means 10. The door top affixing means 10 having a locking tab 11 at one end to secure the apparatus to a door 21. The door top affixing means is also used to be affixed to a clothing rail inside of a closet along with the other garments when the apparatus is not in use.

FIG. 2 shows a cutaway view of the box 4 exposing the protective roll 16 installed therein. A lower vertical supporting member 3 is shown affixed to a bottom supporting member 14. At the top of lower vertical supporting member 3 is a rod 5 for inserting into a slot 12 of box 4. The rod 5 has a substantial width that allows for stability when the box 4 is installed onto the rod 5. Affixed to one end of the bottom supporting member 14 and extending upwards, is a clothing hanger supporting member 7 with a clothing hanger supporting means 6 located at the top. Support member 2 is affixed to rod 5 via hook 26. It should be noted that a multiplicity of other means could easily be substituted. Support member 2 is also rotatably affixed to door affixing means 10 via 25 that will allow the apparatus 1 to be easily stored into a closet along with other garments.

Figure 3:
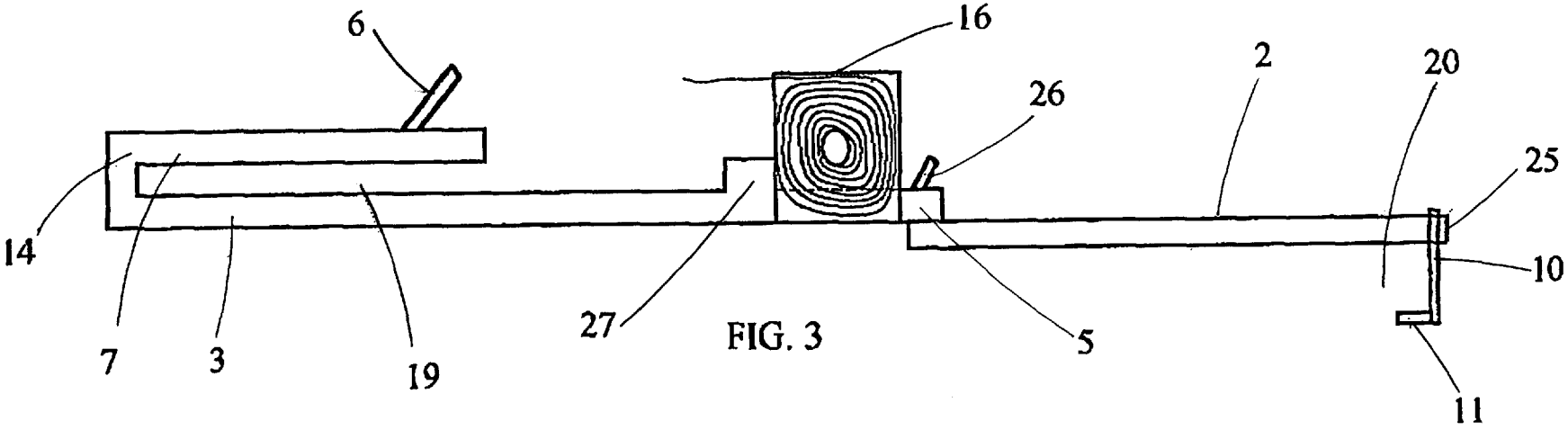
FIG. 3 is a side horizontal view of the clothing protection apparatus clearly showing the space between the clothing affixing means and the lower structural member to allow the protective covering to be pulled down around the clothing garment to be protected.
Figure 4:
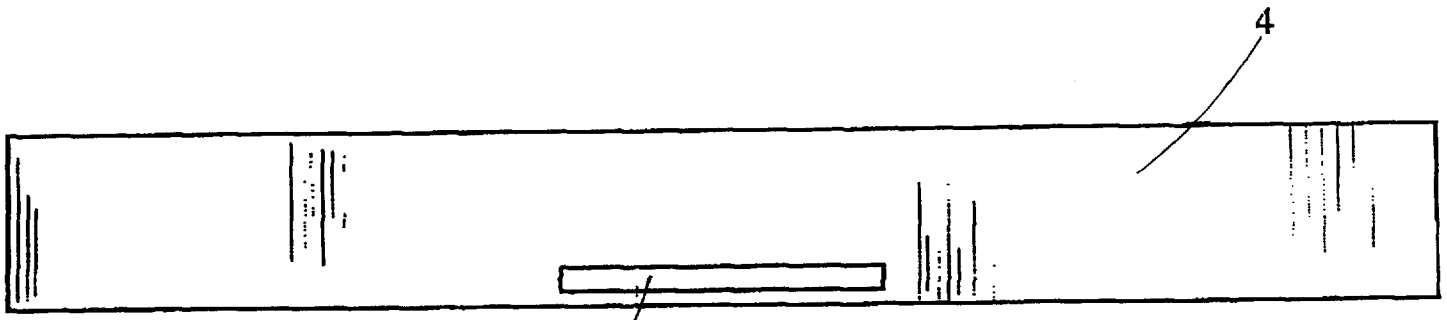
FIG. 4 is a top view of the box dispenser for housing the roll of protective covers having a slot for affixing to the lower support members.

Referring to FIG. 3, we see a side horizontal view of the clothing protection apparatus 1 assembled having a support member 2 affixed to a door top affixing means 10. The door top affixing means having a locking tab 11 at one end thereby allowing the apparatus 1 to be secured to a door. The locking tab 11, supporting member 2 and the door top affixing means 10 forms a cavity 20 which is large enough to accept the thickness of a door 21. FIG. 3 shows a cutaway view of the box 4 showing the flexible roll 16 inside and rod 5 inserted through the box 4. A lower vertical supporting member 3 is shown affixed to rod 5. At one end, the lower vertical supporting member 3 is affixed to a bottom supporting member 14. Affixed to one end of the bottom supporting member 14 and extending upwards, is a clothing hanger supporting member 7 with a clothing hanger supporting means 6 located at the top. The hanger supporting member 7, lower vertical supporting member 3 and bottom supporting member 14 form a cavity 19 which allows a protective sheet 23 to be substantially installed over a garment 22 before removal of the garment from the apparatus 1. Rod 5 is allowed to be inserted into the box 4 a given maximum distance, and then is prevented from further insertion flange 27. Flange 27 prevents the box 4 from sliding too far down the rod 5 and thereby blocking cavity 19.

Figure 5:
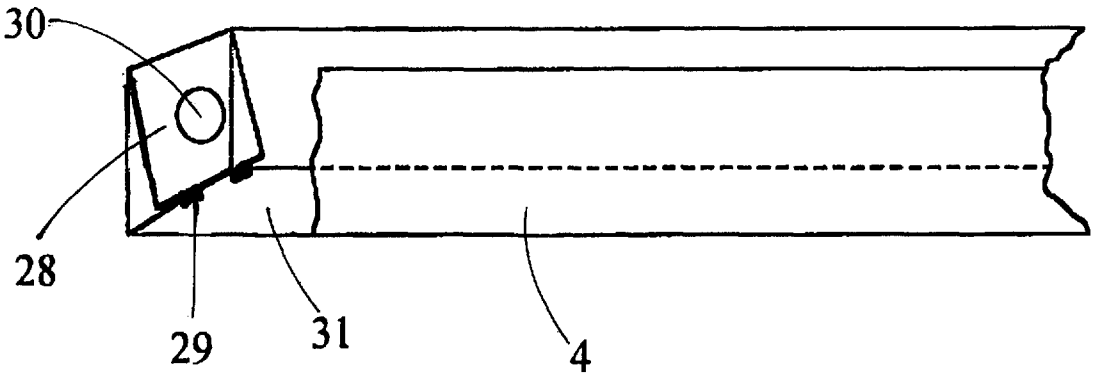
FIG. 5 is an orthographic cutaway view of the box exposing an inside panel at one end having an opening and tabs for allowing the protective covering to spin freely.
Figure 6:
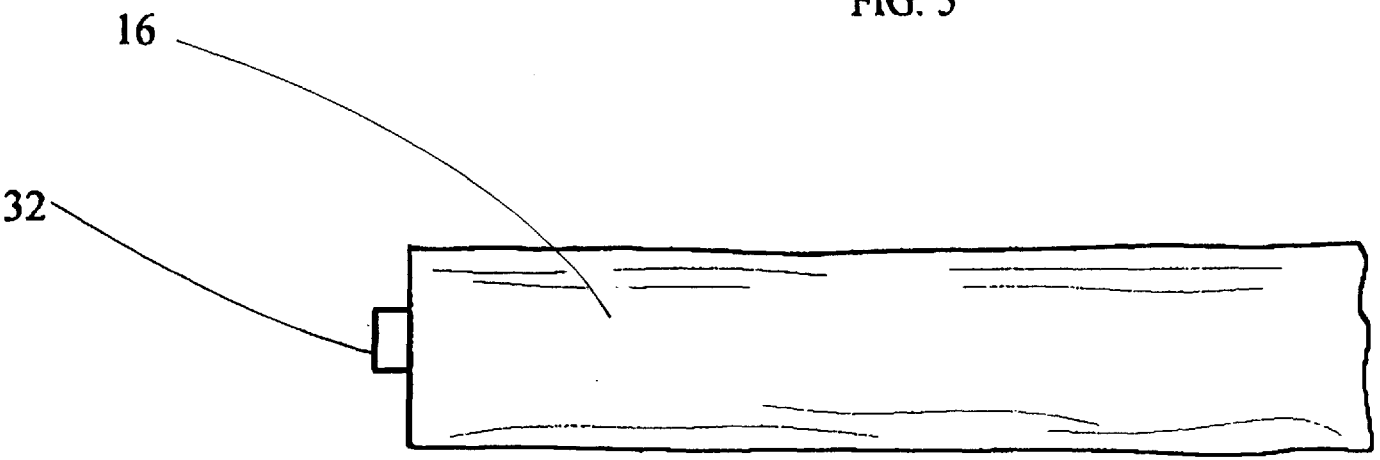
FIG. 6 shows a side view of the protective roll wrapped around a solid tube that is inserted into the opening of FIG. 5.

FIG. 5 and 6 show another feature of the box 4 having a means to allow the roll 16 to spin freely inside. Inside of the box 4 at both distant ends will be a flap 28 having a generally round opening 30. At the bottom end of the flap 28, at least one tab 29 is used to affix the flap 28 to the bottom side 31 of the box 4. Note, slots are provided for allowing the tabs 29 to be inserted in the bottom side 31 of the box 4, but are not shown in the Figures. The solid tube 32 protrudes from both ends of the roll 16 and is inserted into the openings 30 at both ends of the box 4. The opening 30 is used to allow a solid tube 32 of roll 16 to rest thereon and to spin freely.

Accordingly, a very unique, attractive, convenient method and apparatus are provided for protecting clothing articles from dust and other contaminants when the garments are in storage or during transportation.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A clothing protection apparatus for protecting clothing during storage or transportation, the clothing protection apparatus comprising:

(a) at least one door affixing means having a rod of a given length, said rod having a substantially U-shaped end inverted to affix over the top of a door, (b) a support member affixed to the door affixing means and extending downwardly, said support member having a means of rotating freely about an axis parallel to said length wise axis of said support member;

(c) a box dispenser having at least one roll of protective covers therein, said box having a top side and a bottom side, said top and bottom side having a slot for allowing a rod to be inserted through, said rod being affixed to said support member, said box having a dispensing slot for allowing said protective covers to be dispensed therethrough, (d) at least one clothing hanger support affixed to said rod, said clothing hanger support having a substantially U-shaped configuration, said clothing hanger support having a cavity to allow a protective cover to slide in a given distance, said clothing hanger support having a clothing hanger affixing means at the end.

2. A clothing protection apparatus as set forth in claim 1 wherein said roll protective covers are allowed to spin easily inside said box dispenser.

3. A clothing protection apparatus as set forth in claim 1 wherein said clothing hanger affixing means has a cavity large enough to accept the hook end of a clothes hanger.

4. A clothing protection apparatus as set forth in claim 1 wherein said box is disposable once the protective covers have been discarded.

5. A clothing protection apparatus as set forth in claim 1 wherein said box has a means to allow said protective roll to spin freely, said means comprising of a flap at each end of said box with a generally round opening, said protective roll having a solid tube protruding from both ends, said tube supported by said openings.

* * * * *